US006092532A

United States Patent [19]

Focke

[11] Patent Number: 6,092,532

[45] Date of Patent: Jul. 25, 2000

[54] INSTALLATION FOR MANUFACTURING AND PACKAGING CIGARETTES

[75] Inventor: Heinz Focke, Verden, Germany

[73] Assignee: Focke & Co. (GmbH & Co.), Verden, Germany

[21] Appl. No.: 09/087,715

[22] Filed: May 28, 1998

[30] Foreign Application Priority Data

Jun. 5, 1997 [DE] Germany ..... 197 23 689

[51] Int. Cl.[7] ..... A24C 5/35; A24C 1/14; A24C 5/32

[52] U.S. Cl. ..... 131/283; 131/280; 131/282

[58] Field of Search ..... 131/280, 283, 131/282

[56] References Cited

U.S. PATENT DOCUMENTS

| | | | |
|---|---|---|---|
| 3,532,388 | 10/1970 | Rowlands et al. | 302/2 |
| 4,149,545 | 4/1979 | Hall | 131/25 |
| 4,903,713 | 2/1990 | Clarke | 131/283 |
| 4,944,315 | 7/1990 | Focke | 131/283 |

FOREIGN PATENT DOCUMENTS

| | | |
|---|---|---|
| 2718125A1 | 11/1978 | Germany . |
| 3038035A1 | 4/1981 | Germany . |
| 3808963A1 | 10/1988 | Germany . |
| 3742955A1 | 6/1989 | Germany . |
| 19517368A1 | 11/1995 | Germany . |
| 2061858 | 5/1981 | United Kingdom . |
| 2202816 | 10/1988 | United Kingdom . |

*Primary Examiner*—James Derrington
*Assistant Examiner*—Robert McBride
*Attorney, Agent, or Firm*—Abelman, Frayne & Schwab

[57] ABSTRACT

An installation for manufacturing and packaging cigarettes consists of a production station (10) and a packaging station (11). The production station (10) consists of a plurality of, especially two, manufacturing machines (12, 13) positioned in a special way in relation to one another. The cigarettes produced by the two manufacturing machines (12, 13) are processed by a common packaging machine (14), in order to produce cigarette packets.

1 Claim, 3 Drawing Sheets

INSTALLATION FOR MANUFACTURING AND PACKAGING CIGARETTES

SPECIFICATION

Figure 1:
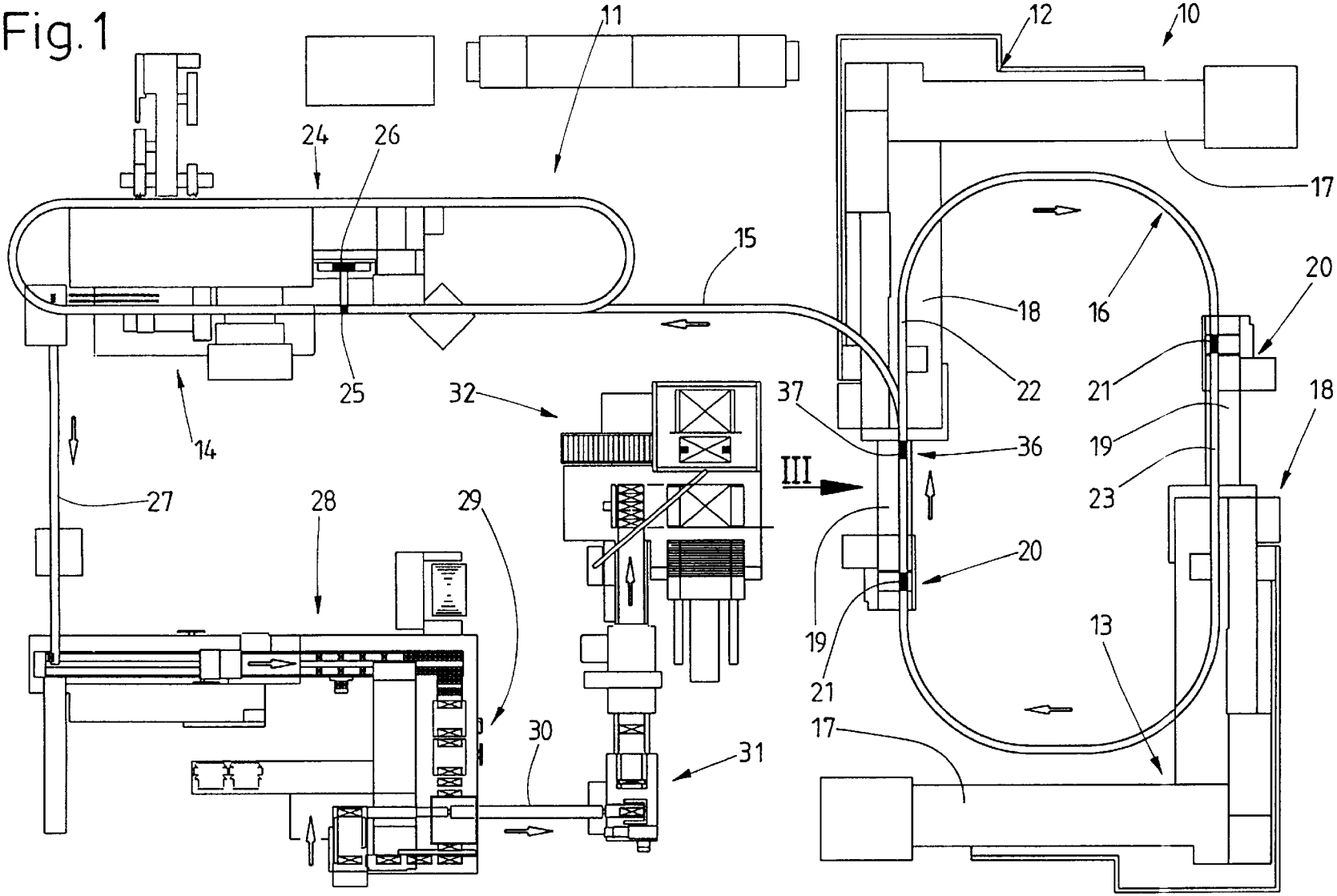

The invention relates to an installation for manufacturing and packaging cigarettes consisting of a manufacturing station for cigarettes and a packaging station which is connected to the manufacturing station by at least one cigarette conveyor.

The production and packaging of cigarettes ready for dispatch is increasingly done by efficient "lines", i.e. plants in which the manufacture of the cigarettes is coupled with the packaging of same in a continuous process flow. The production of the cigarettes must here be matched to the capacity of packaging machines which follow. Plants are known in which a cigarette-manufacturing machine (maker), laid out with a double track, is disposed in front of an efficient packaging machine.

The purpose underlying the invention is so to further develop and improve installations for manufacturing and packaging cigarettes or similar products that high output of the whole installation can be maintained over a longer period of time.

In fulfilment of this purpose, the installation according to the invention is characterised in that a packaging machine for manufacturing cigarette packets is connected to two cigarette-manufacturing machines and in that the (permanent) output of the packaging machine substantially corresponds to the common (permanent) output of the two cigarette-manufacturing machines.

On the installation according to the invention there is pre-set co-ordination between the manufacture of the cigarettes and the packaging of same, within a margin. However, two separate, i.e. working independently, complete cigarette-manufacturing machines (makers) are disposed in front of a common packaging machine for cigarette packets. The cigarettes produced by the two cigarette-manufacturing machines are continuously led to the packaging machine and processed there to produce the packets of cigarettes.

The surprising advantage of this solution lies in a higher output of the installation over a longer period of time. If there is intermittent interruption of the cigarette production in the region of only one of the two manufacturing machines, the whole installation (line) can continue to run with reduced output, namely approximately half. Only if both cigarette-manufacturing machines fail, or the packaging machine fails, does the whole installation have to be switched off. For this reason, there is a noticeable improvement in efficiency measured over a longer period of time.

A further special characteristic of the invention consists in its ingenious assembly, namely the relative disposition of the two cigarette-manufacturing machines on the one hand and of the subsequent packaging machines on the other hand. In terms of functionality, especially the cigarette-manufacturing machines arranged in a rectangular formation and angular in ground plan or in plan view are connected with special advantages. These machines deliver the cigarettes to a common cigarette conveyor carrying them to the packaging machine, preferably to a loop conveyor which is arranged above the cigarette-manufacturing machines and which simultaneously serves the purpose of a cigarette store.

The packaging machine also, a film-wrapping unit arranged after same, a so-called carton-packing unit and a box-packing unit are positioned in special positions relative to one another. The arrangement of all the machines and devices is chosen to be such that it is possible for a plurality of machines to be monitored by just one person.

Figure 2:
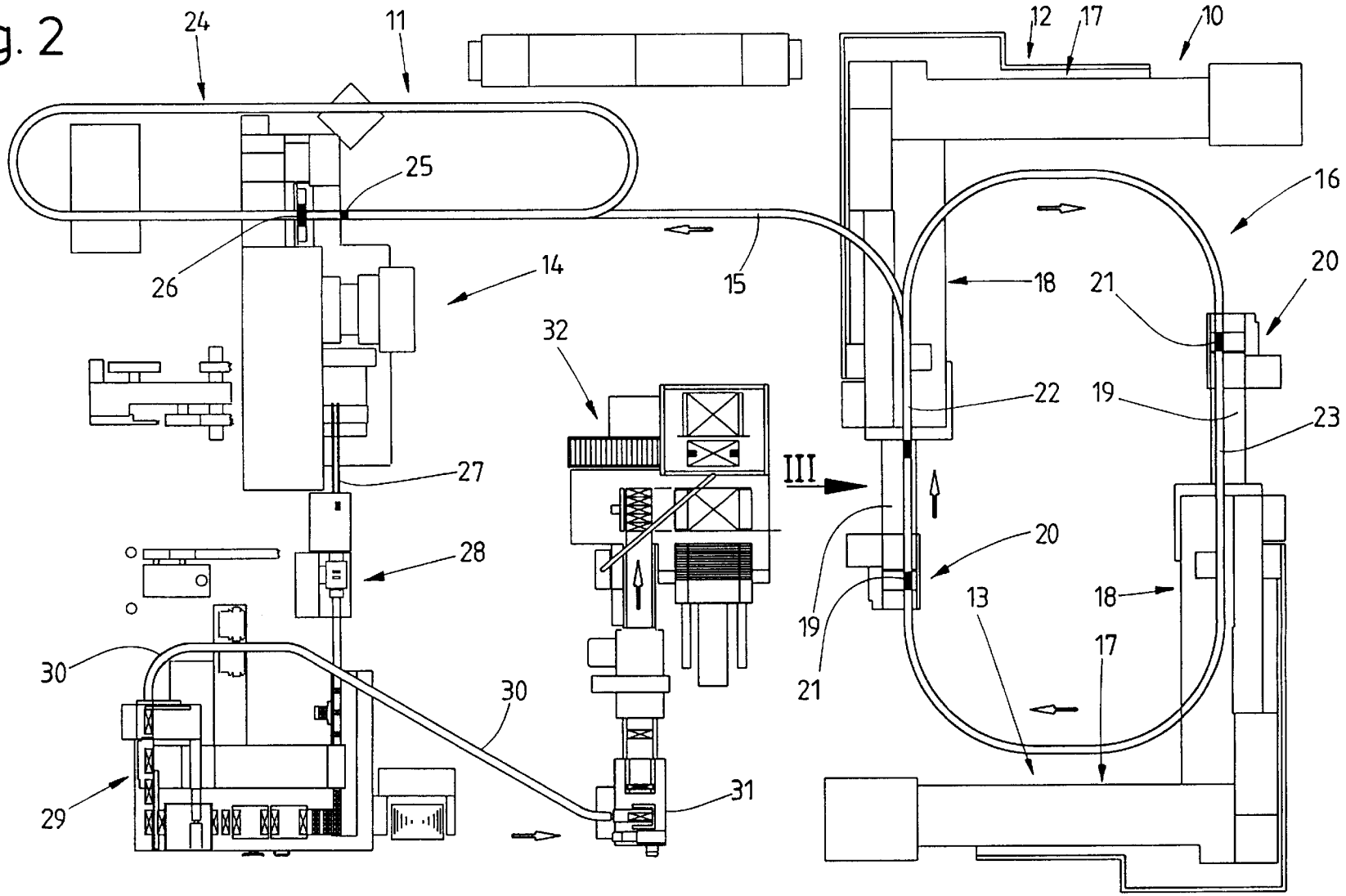
Figure 3:
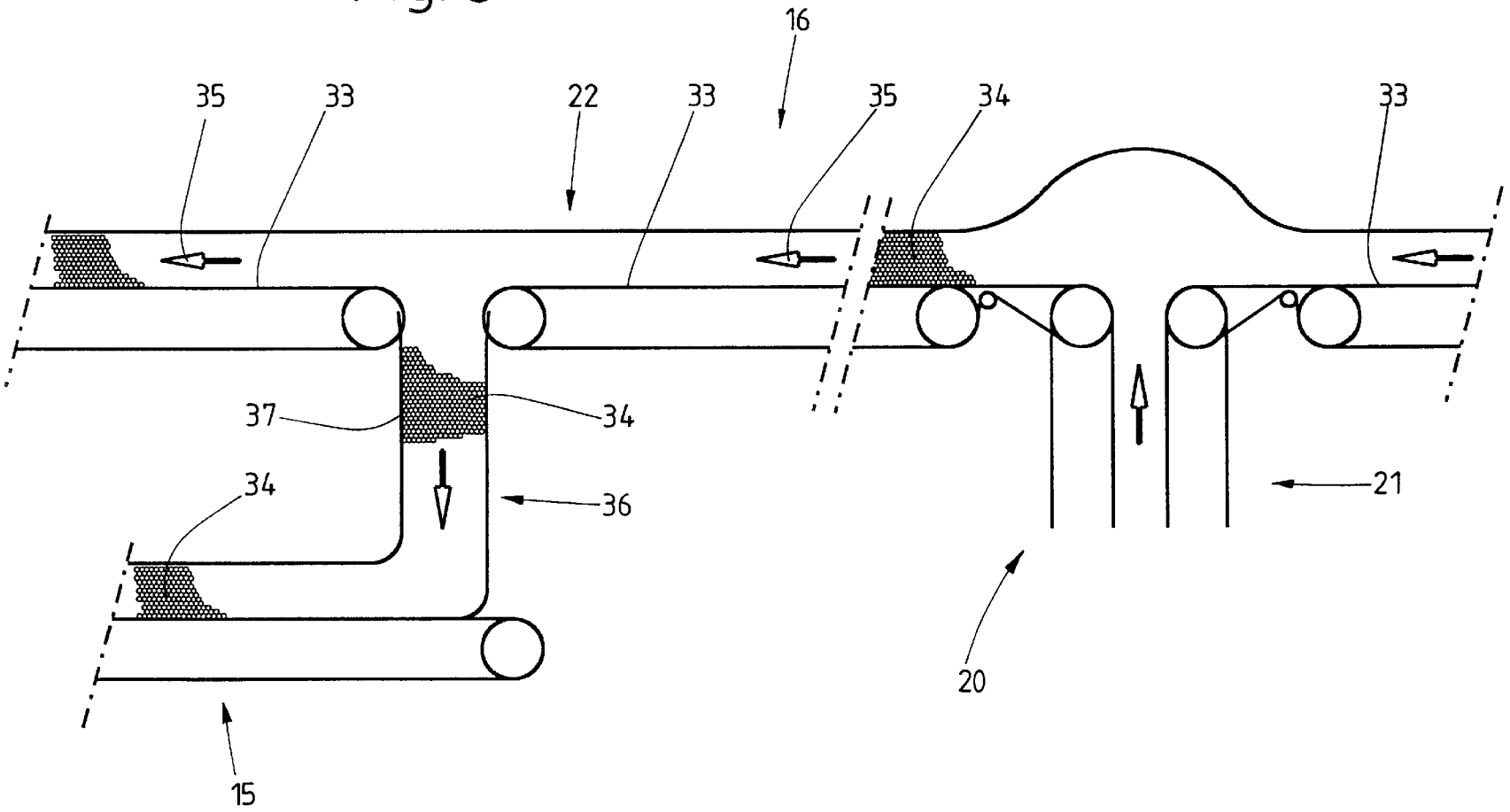

Further features and special characteristics of the installation according to the invention are described in greater detail below with the aid of embodiments, given by way of example and shown in the drawings. These show:

FIG. 1 an installation for manufacturing and packaging cigarettes, in ground plan, FIG. 2 a view corresponding to FIG. 1 for another form of embodiment of the installation, FIG. 3 a detail of the installation, in side view as per arrow III in FIG. 1 and FIG. 2.

In FIGS. 1 and 2, complex plants or installations for manufacturing and packaging cigarettes ready for dispatch are shown diagrammatically in plan view. Basically, the installation consists of a production station 10 for the cigarettes and a packaging station 11. The machines and devices of the production station 10 are matched in respect of their output to the processing capacity of the machines and devices of the packaging station 11.

The production station 10 consists of two machines for producing cigarettes (so-called makers) 12 and 13 which are independent, i.e. work independently of one another. The production yield of the two manufacturing machines 12 and 13 is led to a first packaging machine 14. The latter produces standard cigarette packets. The present embodiment shows a packaging machine 14 for producing cigarette packets of the soft pouch type. The permanent capacity of the packaging machine 14 is laid out in such a way that the production of the two manufacturing machines 12, 13 can be processed. By preference, the (permanent) capacity of the two manufacturing machines 12, 13 is approximately the same. The production yield of the packaging machine 14 can be, for example, 700 cigarette packets per minute. This means that each manufacturing machine 12, 13 produces approximately 7000 cigarettes per minute.

The cigarettes produced by the two manufacturing machines 12, 13 are led to the packaging machine 14 by a common cigarette conveyor 15. The latter is in turn connected with a collecting conveyor for the cigarettes, namely with a loop conveyor 16 which, because of its design and receiving capacity, serves at the same time as a cigarette store. The cigarette conveyor 15 branches away from the closed loop conveyor 16, which in the present case is configured approximately oval.

A special characteristic is the positioning of the two cigarette-manufacturing machines 12, 13 in the region of the production station 10. The manufacturing machines 12, 13 are configured angular or L-shaped in ground plan with two limbs 17, 18 disposed at a right angle to one another. This form of ground plan of the manufacturing machines 12, 13 is determined by their function. Limb 17 is an extrusion unit of the manufacturing machine, i.e. the region in which a continuous length of cigarettes is formed, wrapped by cigarette paper. The transverse limb 18 is a filter-applying unit, i.e. a machine in the region of which filters are attached to the cigarettes. Joining on to the free end of limb 18, i.e. at an exit point from the filter-applying unit, there is a connecting conveyor 19 as an extension of limb 18. The finished cigarettes are led by the conveyor 19 to a transfer assembly 20. In the region of the latter, the cigarettes are conveyed by a vertical conveyor 21 in an upwards direction into the loop conveyor 16, or into the cigarette store.

The two manufacturing machines 12, 13 are positioned in a special way, taking into account the form of ground plan described. The contours of a rectangle are circumscribed.

The L-shaped manufacturing machines 12, 13 are positioned with their inner sides facing one another and lying diagonally opposite one another, i.e. "diagonally across" the imaginary rectangle. The longer limbs 18 with the connecting conveyor 19 here extend over the longer side of the rectangle, below longer straight sections 22, 23 of the loop conveyor 16. This positioning of the manufacturing machines 12, 13 results on the one hand in the optimum use of space. On the other hand, however, monitoring of both manufacturing machines 12, 13 is possible by one person who can stay within the enclosed or imaginary rectangle.

The cigarette conveyor 15, which joins on to the loop conveyor 16 in an arc shape in the region of section 22, leads in the present case to a cigarette store 24 arranged above the packaging machine 14 and likewise elongated and oval. From this store, the cigarettes are led as required via a downward conveyor 25 to the packaging machine 14, to a cigarette magazine 26 of known construction.

The finished cigarette packets—without their outer covering of film—are picked up at an exit side of the packaging machine 14 from a packet conveyor 27 and led transversely to the longitudinal extension of the packaging machine 14 to a (twin-track) film-wrapping unit 28. On the layout according to FIG. 1, the latter unit is disposed parallel to the packaging machine 14. In the region of the film-wrapping unit 28, the outer wrapping of transparent foil or plastic film is applied.

The cigarette packets completed to this extent are transferred from the film-wrapping unit 28 directly to a transverse carton-packing unit 29. The latter works substantially at right angles to the film-wrapping unit 28, i.e. is arranged roughly in an L-shape with same. The carton-packing unit 29 produces (small) bundles of generally ten cigarette packets.

The bundles (cartons) produced in the region of the carton-packing unit 29 are transported further by a carton conveyor 30, first of all to packet weighing scales 31. In the region of these scales the weight of the individual bundles or cartons is checked and thus the correct design and/or filling of same. In addition, members are provided which check the bundles for undesired contents made of metal etc. Faulty packets are eliminated here.

From the packet weighing scales 31 the bundles are led in a direction transverse to the carton conveyor 30, namely in the direction of the packaging machine 14, to a box-packing unit 32. In the region of the latter, the cigarette packets are made ready for dispatch, i.e. the bundles are packed into boxes. The cigarettes are thus ready for distribution.

The film-wrapping unit 28, the carton-packing unit 29 and the box-packing unit 32 are positioned in such a way that optimum use is made of the ground space. Moreover, it is possible for the machines to be monitored by only a few people who stay predominantly in the space enclosed by the machines mentioned, including the packaging machine 14.

The machines can be configured in an appropriate manner. It is advantageous, however, if the film-wrapping unit 28 is configured in detail as per DE 37 28 716. The carton-packing unit 29 can correspond to DE 197 16 930. DE 38 16 856 shows an expedient embodiment for the box-packing unit.

FIG. 2 differs from the embodiment shown in FIG. 1 by having differences in respect of the relative position of individual machines and assemblies. The production station 10 corresponds to the embodiment as per FIG. 1. The elongated packaging machine 14 is positioned at right angles to the cigarette store 24, i.e. parallel to the limbs 18 of the manufacturing machine 12, 13. By this means, the film-wrapping unit 28, working in a single track in this example, can join directly on to the packaging machine 14, as an extension of same. The carton-packing unit 29 is aligned transversely to same. The carton conveyor 30 runs above the machines mentioned. The subsequent assemblies, namely the packet weighing scales 31 and box-packing unit 32 are arranged in the same position as on the embodiment of FIG. 1.

This results overall in a cigarette and packet flow via external tracks up to a central region of an area occupied by the machines and assemblies, namely up to the box-packing unit 32 which is positioned approximately central.

The loop conveyor 16 associated with the production station 10 can be advantageously configured in the manner shown in DE 37 42 955. FIG. 3 shows in front elevation as per arrow III a section of the loop conveyor 16. The cigarettes coming from a manufacturing machine 12, 13 are led by the vertical conveyor 21 in an upward direction into the loop conveyor 16. The latter forms, on belt conveyors 33 running round about it, a multilayer stream of cigarettes 34. This stream is conveyed constantly by the loop conveyor 16 in a direction as per arrow 35. In the region of a (single) removal station 36, the cigarettes are led down a removal shaft to the cigarette conveyor 15 which leads to the packaging machine 14 in the manner described.

Instead of the two manufacturing machines 12, 13, the installation can have a plurality of manufacturing machines, e.g. three, which, with a corresponding partial output, produce cigarettes for the common packaging machine 14. In addition, the installation is suitable for producing and handling other objects, insofar as these are manufactured in a comparable manner.

What is claimed is:

1. Apparatus for manufacturing and packaging cigarettes, comprising a production station (10) for the manufacture of cigarettes and a packaging station (11) for packaging the cigarettes, wherein:

(a) two independently operating manufacturing machines (12, 13) for cigarettes are assigned to a common packaging machine (14) for the manufacture of cigarette packs, (b) the two manufacturing machines (12, 13) are connected to the packaging machine (14) via a common cigarette conveyor (15), (c) the output of the packaging machine (14) corresponds substantially to the combined output of the two manufacturing machines (12, 13), (d) a packaging machine for wrapping cigarette packs in a film includes a film-wrapping unit (28) disposed with respect to its working direction parallel to the packaging machine (14) and at a distance from same, (e) the packaging machine (14) is connected to the film-wrapping unit (28) via a pack conveyor (27) which runs transverse to the packaging machine (14) and to the film-wrapping unit (28), (f) the film-wrapping unit (28) is immediately followed by a bundle-packing unit, including a carton-packing unit (29), with a transverse working direction with respect to said wrapping unit (28), (g) a box-packing unit (32) for filling the bundles produced by the carton-packing unit (29) wherein the working directions of the box packing unit (32) and carton-packing unit (29) are parallel and the units are located at a distance from each other, (h) the carton-packing unit (29) is connected to a box-packing unit (32) via a carton conveyor (30), and (i) the box-packing unit (32) is arranged in a space surrounded by the packaging machines (11, 28, 29) and the manufacturing machines (12, 13).

* * * * *